US011072768B2

(12) United States Patent
Delaney et al.

(10) Patent No.: US 11,072,768 B2
(45) Date of Patent: Jul. 27, 2021

(54) LOW PH FABRIC CARE COMPOSITIONS

(71) Applicant: The Procter & Gamble Company, Cincinnati, OH (US)

(72) Inventors: Sarah Ann Delaney, Hebron, KY (US); Kevin Michael Chaney, West Chester, OH (US); Philip John Porter, Mason, OH (US); Brian Joseph Loughnane, Sharonville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/673,997

(22) Filed: Nov. 5, 2019

(65) Prior Publication Data

US 2020/0140789 A1 May 7, 2020

Related U.S. Application Data

(60) Provisional application No. 62/756,672, filed on Nov. 7, 2018.

(51) Int. Cl.

| | |
|---|---|
| ***C11D 7/50*** | (2006.01) |
| ***C11D 7/26*** | (2006.01) |
| ***C11D 7/44*** | (2006.01) |
| ***C11D 11/00*** | (2006.01) |

(52) U.S. Cl.

CPC ..... *C11D 7/5022* (2013.01); *C11D 7/265* (2013.01); *C11D 7/44* (2013.01); *C11D 11/0017* (2013.01)

(58) Field of Classification Search

CPC ..... C11D 3/001; C11D 3/50; C11D 11/0017; C11D 3/2075; C11D 3/382; C11D 7/265

See application file for complete search history.

(56) References Cited

U.S. PATENT DOCUMENTS

| | | | |
|---|---|---|---|
| 4,828,750 | A | 5/1989 | Simion |
| 5,244,593 | A | 9/1993 | Roselle |
| 5,641,739 | A | 6/1997 | Kott |
| 5,935,921 | A | 8/1999 | Meunier |
| 6,262,003 | B1 | 7/2001 | Leonard |
| 6,361,768 | B1 | 3/2002 | Galleguillos |
| 7,018,977 | B2 | 3/2006 | Martens |
| 7,026,278 | B2 | 4/2006 | Price |
| 7,695,523 | B2 | 4/2010 | Corradini |
| 2002/0111285 | A1 | 8/2002 | Price |
| 2005/0156141 | A1 | 7/2005 | Corradini |
| 2007/0086971 | A1 | 4/2007 | Diet |
| 2007/0105744 | A1 | 5/2007 | Amiconi |
| 2008/0045431 | A1 | 2/2008 | Corradini |
| 2008/0287330 | A1 | 11/2008 | Corradini |
| 2013/0111675 | A1 | 5/2013 | Soontravanich |
| 2014/0026331 | A1 | 1/2014 | Frankenbach |
| 2014/0349908 | A1 | 11/2014 | Delaney |
| 2016/0024436 | A1 | 1/2016 | Vetter |
| 2016/0186096 | A1 | 6/2016 | Eberhardt |
| 2017/0240845 | A1 | 8/2017 | Harris |
| 2018/0187129 | A1 | 7/2018 | Traistaru |
| 2020/0140791 | A1 | 5/2020 | Delaney |

FOREIGN PATENT DOCUMENTS

| | | | |
|---|---|---|---|
| CN | 106029859 | A | 10/2016 |
| DE | 19923303 | A1 | 11/2000 |
| EP | 0090291 | A2 | 10/1983 |
| EP | 2853583 | A1 | 4/2015 |
| JP | H08337969 | A | 12/1996 |
| JP | 2017509806 | A | 4/2017 |
| KR | 20150100464 | A | 9/2015 |
| WO | 9218595 | A1 | 10/1992 |
| WO | 9604940 | A1 | 2/1996 |
| WO | 2008084460 | A1 | 7/2008 |
| WO | 2008111007 | A2 | 9/2008 |
| WO | 2015130084 | A1 | 9/2015 |
| WO | 2015130085 | A1 | 9/2015 |
| WO | 2018007201 | A1 | 1/2018 |
| WO | 2018056659 | A1 | 3/2018 |
| WO | 2018108517 | A1 | 6/2018 |

OTHER PUBLICATIONS

All Office Actions; U.S. Appl. No. 16/674,000.

Extended European Search Report and Search Opinion; Appl. No. 19207131.4; dated Mar. 24, 2020; 8 pages.

Extended European Search Report and Search Opinion; Appl. No. 19207280.9; dated Apr. 14, 2020; 13 pages.

Jo Mantini, "Citric Acid: How to Make Your Softener and Dishwasher Rinse-Aid", Jul. 5, 2019, available at https://thegreenboutique.co.uk/blogs/news/citric-acid-how-to-make-your-softener-and-dishwasher-rinse-aid, 7 pages.

Melissa, "Plastic Reduction Mission 5: Fabric Softener Alternatives", Feb. 9, 2015, available at https://threehundredandsixtysix.wordpress.com/2015/02/09/plastic-reduction-mission-4-fabric-softener-alternatives/, 10 pages.

Natalie Kay Smith, WikiHow—4 Ways to Restore Faded Clothes, Method 2; accessed at https://www.wikihow.com/Restore-Faded-Clothes, dated Nov. 6, 2019, 5 pages.

Rachel, "Make your own fabric softener with natural ingredients", Apr. 14, 2015, available at https://www.whatagreenlife.com/make-your-own-fabric-softener-with-natural-ingredients/, 4 pages.

Sodasan Peach Fabric Softener Bag in a Box—5L, available at https://www.ethicalsuperstore.com/products/sodasan/sodasan-fabric-softener----5l/, 3 pages. Accessed Nov. 9, 2020.

TGC042 kiyomi fabric softener, available at https://tangentgc.com/collections/frontpage/products/tgc042-kiyomi-fabric-softener, 5 pages. Accessed Nov. 9, 2020.

Veronique Iorio, "10 DIY Ecological Detergents to keep your home (or bnb) naturally clean", May 18, 2016, available at https://ecobnb.com/blog/2016/05/diy-ecological-detergents/, 18 pages.

Gillette et al. "The White House Cookbook", accessed on https://www.gutenberg.org/files/13923/13923-h/13923-h.htm, Jan. 28, 2021, 2 pages.

*Primary Examiner* — John R Hardee

(74) *Attorney, Agent, or Firm* — Gregory S. Darley-Emerson

(57) ABSTRACT

Liquid fabric care compositions that includes vinegar and/or acetic acid; fragrance materials; and water; where the fragrance materials are characterized by a log P of less than about 2.5; and where the fabric care composition is characterized by an acidic pH. Related processes of making and using such compositions.

18 Claims, No Drawings

LOW PH FABRIC CARE COMPOSITIONS

FIELD OF THE INVENTION

The present disclosure relates to liquid fabric care compositions that includes vinegar and/or acetic acid, fragrance materials, and water. The fragrance materials may be characterized by a log P of less than about 2.5, and composition may be characterized by an acidic pH. The present disclosure also relates to processes of making and using such compositions.

BACKGROUND OF THE INVENTION

Many of today's consumers are sustainably minded and wish to use consumer products that include naturally sourced ingredients. Other consumers are inclined towards "hip" or "retro" consumer products, which may employ ingredients, methods, or brands that their grandmothers might have used, but with a modern twist.

Vinegar is an ingredient that that can fit the bill for both. Vinegar has long been used in various treatment applications around the house. For example, vinegar or solutions thereof may be used to de-scale shower heads or faucets, to clean hard surfaces such as floors or windows, or even to treat fabrics in a laundering process.

However, vinegar can have a strong odor, typically due to the acetic acid content. Consumers may be turned off by products having such an odor. Additionally, surfaces, for example fabrics, treated with such products may carry a residual smell of vinegar, much to the chagrin of the consumer.

To improve consumer acceptance of consumer products that include vinegar, manufacturers may try to use perfumes to mask the odor. Certain fragrances can also signal to the consumer that a surface is clean or otherwise fresh. However, many fragrance materials that are commonly used in household products are oils or otherwise hydrophobic, meaning that aqueous products formulated with such perfumes may be physically unstable.

To improve incorporation into an aqueous product, the fragrance materials may be emulsified, but emulsification brings additional challenges. For example, many emulsifiers, such as common nonionic surfactants like NEODOL® nonionic surfactants (ex Shell), are synthetically made and may be undesirable to consumers that seek naturally sourced products. Emulsified droplets may require additional structuring of products, adding cost. Furthermore, emulsified droplets of perfume may result in an aqueous product being hazy or even opaque, when transparent products that connote "purity" to the consumer are desired.

There is a need for consumer products that contain vinegar and that are characterized by acceptable stability and olfactory profiles.

SUMMARY OF THE INVENTION

The present disclosure relates to fabric care compositions and processes that include the use of acetic acid and/or vinegar in combination with certain perfumes.

For example, the present disclosure relates to a liquid fabric care composition that includes: from about 0.1% to about 20% vinegar, by weight of fabric care composition; from about 0.1% to about 20% fragrance materials, by weight of the fabric care composition, where the fragrance materials are characterized by a log P of less than about 2.5; and at least about 30% water, by weight of the fabric care composition; where the fabric care composition is characterized by a neat pH of from about 1 to about 6.

The present disclosure also relates to an aqueous liquid fabric treatment composition that includes: an organic acid system that includes acetic acid; fragrance material, where the fragrance material is characterized by a log P of no greater than 2.5; where the fabric care composition is characterized by a neat pH of from about 1 to about 6.

The present disclosure also relates to a process of making a liquid fabric care composition, the process including the steps of: providing an aqueous (liquid) base that includes water, for example at least 50% water; combining vinegar with the aqueous base; combining fragrance materials with the aqueous base, where the fragrance materials, as added to the aqueous base are characterized by a log P of no greater than 2.5; where the resulting liquid fabric care composition is characterized by a neat pH of from about 1 to about 6.

DETAILED DESCRIPTION OF THE INVENTION

The present disclosure relates to aqueous fabric treatment compositions that include acetic acid, for example in the form of vinegar, and fragrance materials. The acetic acid may be in the form of vinegar. The fragrance materials are selected so as to be relatively hydrophilic compared to many other common fragrance materials. Such hydrophilicity may be quantified by log P measurements, described in more detail below.

Without wishing to be bound by theory, it is believed that the selection of such hydrophilic fragrance materials in the presently described compositions and related processes can provide one or more advantages over traditional fragrance materials. Because the fragrance materials are hydrophilic, they typically dissolve in the aqueous compositions, resulting in improved phase stability. Due to their relative hydrophilicity, it is not necessary to emulsify the fragrance materials prior to addition to the aqueous compositions, which can save on processing steps, formulation space, and/or extra materials (such as structurant and or emulisifying agent). Furthermore, the hydrophilic fragrance materials better facilitate the production of substantially transparent products.

The compositions and processes of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fabric Treatment Composition

The present disclosure relates to fabric treatment compositions. As described in more detail below, the compositions may include acetic acid, which may be in the form of vinegar. The acetic acid may be part of an organic acid system. The compositions may provide cleaning, softness, and/or freshness benefits to a target fabric. For example, it is believed that the acetic acid and/or other organic acids may remove mineral deposits that may build up on fabrics, particularly those washed in hard water, resulting in improved softness.

The fabric treatment compositions are liquid compositions. The liquid composition may be of relatively low viscosity, even similar to that of water. Consumers may desire such low-viscosity compositions due to an association with purity, natural-ness, and/or simplicity. The compositions may be characterized by a viscosity of from about 1 to about 200, or to about 150, or to about 100, or to about 75 cps, or to about 50 cps, or to about 30 cps, or to about 20 cps, or to about 15 cps, or to about 10 cps. As used herein, viscosity is determined by the method provided in the Test Methods section below.

The fabric treatment compositions of the present disclosure are acidic compositions. The fabric treatment compositions of the present disclosure may be characterized by a pH of less than 7, or less than about 6, or less than about 5, or less than about 4, or less than about 3. The fabric treatment compositions of the present disclosure may be characterized by a pH of from about 1, or from about 1.5, or from about 2, to about 6, or to about 5, or to about 4, or to about 3, or to about 2.5. The compositions may have a pH of from about 2 to about 4, or to about 3.

In addition to the organic acids described below, the compositions may comprise additional pH adjusting agents, such as buffer agents and/or neutralizing agents, such as caustic materials (e.g., NaOH).

The compositions of the present disclosure may be characterized by a Reserve Acidity measurement. Without being limited by theory, the Reserve Acidity measurement is found to be the best measure of the acidifying power of a composition, or the ability of a composition to provide a target acidic wash or rinse pH when added at high dilution into tap water as opposed to pure or distilled water. The Reserve Acidity may be controlled by the level of formulated organic acid along with the neat product pH as well as, in some aspects, other buffers. The compositions of the present disclosure may have a Reserve Acidity to pH 4.0 of at least about 1, or at least about 3, or at least about 5. The compositions described may have a Reserve Acidity to pH 4.0 of from about 3 to about 10, or from about 4 to about 7. As used herein, "Reserve Acidity" refers to the grams of NaOH per 100 g of product required to attain a pH of 4.0. The Reserve Acidity measurement as used herein is based upon titration (at standard temperature and pressure) of a 1% product solution in distilled water to an end point of pH 4.00, using standardized NaOH solution.

The fabric treatment compositions of the present disclosure may be substantially transparent. Such compositions may signal purity and/or natural origins (and consequently, lack of synthetic ingredients) to the consumer. The compositions may be characterized by a percent transmittance (% T) of at least about 50%, or at least about 60%, or at least about 70%, or at least about 80%, or at least about 90%, or at least about 95% of light using a 1 centimeter cuvette, at a wavelength of 410-800 nanometers, or 570-690 nanometers, where the composition is substantially free of dyes. For purposes of this disclosure, as long as one wavelength in the visible light range has greater than 50% transmittance, it is considered to be substantially transparent/translucent.

The disclosed compositions may be isotropic at 22° C. As used herein, "isotropic" means a clear mixture, having a % transmittance of greater than 50% at a wavelength of 570 nm measured via a standard 10 mm pathlength cuvette with a Beckman DU spectrophotometer, in the absence of dyes. The percent transmittance is determined according to the method provided in the Test Methods section below.

Alternatively, transparency of the composition may be measured as having an absorbency in the visible light wavelength (from about 410 to 800 nm) of less than 0.3, which is in turn equivalent to at least 50% transmittance using the cuvette and wavelengths noted above.

The compositions of the present disclosure may be present in a single phase. The compositions may be stable according to the Stability method presented in the Test Methods section below.

Organic Acid(s) The fabric treatment compositions of the present disclosure include one or more organic acids. The fabric treatment compositions may include an organic acid system, which may comprise the one or more organic acids. The composition may include at least two organic acids. The organic acid system may comprise at least acetic acid and a second organic acid, such as citric acid. The organic acids of the present disclosure may have a molecular weight of less than about 80 Daltons.

The fabric treatment compositions of the present disclosure may include from about 1% to about 40%, by weight of the composition of the organic acid system. The organic acid system may be present at a level of from about 1%, or from about 2%, or from about 3%, or from about 5%, or from about 10%, or from about 15%, or from about 20%, to about 40%, or to about 35%, or to about 30%, or to about 25%, or to about 20%, by weight of the fabric treatment compositions.

The fabric treatment compositions of the present disclosure may comprise acetic acid. It is believed that acetic acid helps to remove certain residues from fabrics, leaving them cleaner and/or softer. Acetic acid may be present at a level of from about 0.05%, or from about 0.1%, or from about 0.15%, or from about 0.2% to about 5%, or to about 3%, or to about 2%, or to about 1%, or to about 0.5%, or to about 0.3%, by weight of the composition.

The acetic acid may be provided as vinegar. Thus, the fabric treatment compositions of the present disclosure may comprise vinegar. The vinegar may be present at a level of from about 0.5%, or from about 1%, or from about 1.5%, or from about 2%, to about 20%, or to about 15%, or to about 10%, or to about 5%, or to about 4%, or to about 3%, by weight of the composition. Vinegar suitable for use in a domestic kitchen typically comprises about 4% to about 5%, by weight of the vinegar, of acetic acid, although more concentrated forms may be available.

Due to the significant odor of acetic acid, relatively low levels of acetic acid and/or vinegar may be desired, although a certain minimum amount may still be desired to give a performance benefit. While white vinegar typically contains about 4% to about 5% of acetic acid, the compositions of the present disclosure may include acetic acid at a relatively lower level. When the level of acetic acid or vinegar is low, the performance of composition may be improved with the addition of a second organic acid, such as citric acid.

The fabric treatment compositions and/or the organic acid systems of the present disclosure may comprise at least a second organic acid in addition to acetic acid/vinegar. Suitable second organic acids may include citric acid, lactic acid, adipic acid, aspartic acid, carboxymethyloxymalonic acid, carboxymethyloxysuccinic acid, glutaric acid, hydroxyethylliminodiacetic acid, iminodiacetic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof. The fabric treatment composition may include citric acid. It may be preferred to select a second organic acid that can also function as a builder during usage, such as citric acid.

The second organic acid may be present at a greater level than the acetic acid. The second organic acid may be present in the fabric treatment composition at a level of from about 1%, or from about 2%, or from about 3%, or from about 5%, or from about 10%, or from about 15%, or from about 20%, to about 40%, or to about 35%, or to about 30%, or to about 25%, or to about 20%, by weight of the fabric treatment compositions. The acetic acid and the second organic acid, for example citric acid, may be present in a weight ratio of from about 1:300, or from about 1:250, or from about 1:225, or from about 1:200, to about 1:1, or to about 1:10, or to about 1:50, or to about 1:100. It may be desirable to have relatively more of the second organic acid compared to the acetic acid in order to improve performance while minimizing undesirable odor.

Fragrance Materials

The fabric treatment compositions of the present disclosure include fragrance material(s). The fragrance materials are added to provide aesthetically pleasing scent to the liquid product composition, to a treatment liquor, and/or to fabrics treated with the composition. The compositions of the present disclosure may include from about 0.1% to about 20%, or from about 0.2% to about 10%, or from about 0.3% to about 5%, by weight of the composition, of fragrance materials.

Non-limiting examples of fragrance materials include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients.

For the fabric treatment compositions of the present disclosure, it is desirable for the fragrance materials to be relatively hydrophilic. Hydrophilic fragrance materials are more likely to adequately dissolve or disperse in the aqueous compositions of the present disclosure, leading to improved phase stability and/or product transparency.

The degree to which a material or combination of materials is hydrophilic (or hydrophobic) can be described using log P values. Log P is a measure of the distribution of a solute between two immiscible liquid phases, octanol and water, and is generally used as a relative measure of the hydrophobicity of a solute. A perfume ingredient with a relatively greater partitioning coefficient P is more hydrophobic. A perfume ingredient with a relatively smaller partitioning coefficient P is more hydrophilic. Since the partitioning coefficients of the perfume ingredients normally have high values, they are more conveniently given in the form of their logarithm to the base 10, log P.

The fragrance material(s) of the present disclosure, whether a single material or a combination of materials, may be characterized by a log P of no greater than about 2.5, or of no greater than about 2.2, or no greater than about 2. As used herein, the log P of a fragrance material or mixture of fragrance materials is determined according to the method(s) provided in the Test Methods section below. As described in more detail therein, the Consensus log P is typically preferred when available, but alternative methods of determining log P are also provided.

When the fragrance materials include a plurality of materials, each individual material may be characterized by log P, and it may be preferred that a majority, by weight, of the materials are characterized by log P of no greater than about 2.5, or of no greater than about 2.2, or no greater than about 2. At least about 60%, or at least about 70%, or at least about 80%, or at least about 85%, or at least about 90%, or at least about 95%, by weight of the plurality of materials, of the materials may be characterized by log P of no greater than about 2.5, or of no greater than about 2.2, or no greater than about 2. It is believed that greater amounts of such materials will increase phase stability and/or transparency of the composition.

Because of their hydrophilic nature, the fragrance material(s) may be added to the aqueous compositions of the present disclosure without additional processing other than basic mixing. The fragrance materials may be unemulsified fragrance material(s). The fragrance material(s) may be added neat or as part of an aqueous premix.

Individual fragrance materials having a log P value of less than 2.5 include the non-limiting examples listed below in Table A. The compositions of the present disclosure may include one or more fragrance materials that are listed in Table A. One or more of the fragrance materials listed in Table A may be used in combination with additional fragrance materials.

TABLE A

| CAS # | Fragrance Material | LogP Consensus |
|---|---|---|
| 4940-11-8 | ETHYL MALTOL | 0.50 |
| 6413-10-1 | METHYL DIOXOLAN | 0.778 |
| 28940-11-6 | CALONE | 1.164 |
| 121-33-5 | VANILLIN | 1.288 |
| 120-57-0 | HELIOTROPIN | 1.411 |
| 5471-51-2 | PARA HYDROXY PHENYL BUTANONE | 1.42 |
| 928-96-1 | BETA GAMMA HEXENOL | 1.425 |
| 60-12-8 | PHENYL ETHYL ALCOHOL | 1.501 |
| 121-32-4 | ETHYL VANILLIN | 1.588 |
| 100-52-7 | BENZALDEHYDE | 1.609 |
| 104-54-1 | CINNAMIC ALCOHOL | 1.689 |
| 123-11-5 | ANISIC ALDEHYDE | 1.709 |
| 104-55-2 | CINNAMIC ALDEHYDE | 1.761 |
| 122-78-1 | PHENYL ACETALDEHYDE | 1.781 |
| 67633-96-9 | LIFFAROME | 1.824 |
| 105-54-4 | ETHYL BUTYRATE | 1.844 |
| 67845-46-9 | ALDEHYDE XI | 1.845 |
| 91-64-5 | COUMARIN | 1.852 |
| 104-21-2 | ANISYL ACETATE | 1.864 |
| 1191-16-8 | PRENYL ACETATE | 1.894 |
| 2550-26-7 | BENZYL ACETONE | 1.926 |
| 140-11-4 | BENZYL ACETATE | 1.936 |
| 4430-31-3 | OCTAHYDRO COUMARIN | 1.978 |
| 101-41-7 | METHYL PHENYL ACETATE | 1.981 |
| 7452-79-1 | ETHYL-2-METHYL BUTYRATE | 1.985 |
| 123-92-2 | AMYL ACETATE | 1.985 |
| 22457-23-4 | STEMONE | 2.003 |
| 1205-17-0 | HELIONAL | 2.025 |
| 107-75-5 | HYDROXYCITRONELLAL | 2.076 |
| 93-58-3 | METHYL BENZOATE | 2.103 |
| 5462-06-6 | CANTHOXAL | 2.104 |
| 134-20-3 | METHYL ANTHRANILATE | 2.177 |
| 3681-71-8 | CIS 3 HEXENYL ACETATE | 2.189 |
| 66576-71-4 | ISO PROPYL 2-METHYLBUTYRATE | 2.243 |
| 62439-41-2 | METHOXY MELONAL | 2.271 |
| 100-86-7 | DIMETHYL BENZYL CARBINOL | 2.272 |
| 63500-71-0 | PYRANOL | 2.309 |
| 1365-19-1 | LINALOOL OXIDE | 2.341 |
| 103-45-7 | PHENYL ETHYL ACETATE | 2.354 |
| 93-92-5 | METHYL PHENYL CARBINYL ACETATE | 2.377 |
| 59323-76-1 | OXANE | 2.378 |
| 122-63-4 | BENZYL PROPIONATE | 2.387 |
| 103-26-4 | METHYL CINNAMATE | 2.39 |
| 77-83-8 | ETHYL METHYL PHENYL GLYCIDATE | 2.402 |
| 119-36-8 | METHYL SALICYLATE | 2.434 |
| 120-72-9 | INDOL | 2.442 |
| 104-61-0 | NONALACTONE | 2.447 |
| 39255-32-8 | ETHYL 2 METHYL PENTANOATE | 2.47 |
| 97-53-0 | EUGENOL | 2.48 |
| 23911-56-0 | NEROLIONE | 2.484 |
| 76-22-2 | CAMPHOR GUM | 2.49 |

At least a portion of the fragrance materials of the present disclosure may be derived from naturally sourced materials. It is believed that such materials have a lesser environmental impact and/or are more environmentally sustainable compared to synthetically derived and/or geologically derived (such as petroleum-based) materials. At least about 50%, or at least about 60%, or at least about 70%, or at least about 80%, or at least about 90%, or at least about 95%, or about 100%, by weight of the fragrance materials, of the fragrance materials may be naturally derived fragrance materials.

Suitable naturally derived fragrance materials may include: cinnamon, *aronia*, hibiscus, *gardenia*, white rice, lemon balm, chamomile, peppermint, spearmint, sage, bergamot, basil, thyme, oregano, acacia flower, lily, lotus flower, jasmine, rose, lavender, *chrysanthemum*, lilac, apricot, freesia, tulip, *eucalyptus*, rosemary, *magnolia*, apple mint, tea tree, hyacinth, cherry blossoms, lemon *verbena, camellia*, fennel, peach flower, blueberry, raspberry or a mixture thereof.

The fragrance materials may comprise a plant extract, such as a fruit extract, herbal extract, or mixtures thereof. Suitable fruit extracts may comprise citrus extract, preferably lemon extract. Suitable herbal extracts may comprise lavender extract, rosemary extract, thyme extract, basil extract, or mixtures thereof, preferably lavender extract.

Certain fragrance materials, including naturally derived materials such as certain extracts, may be relatively hydrophobic; for example, some may have a log P of greater than about 2.5. Such materials, and/or the parent materials from which they are derived, may undergo processing steps to increase the relative hydrophilicity of the fragrance materials. For example, lemon extract prepared by one process may have a log P that is different/more hydrophobic than another lemon extract prepared by a different process. With regard to the presently described fragrance materials, at least a portion of the fragrance materials may be prepared with a solvent-extraction process. It may be particularly preferably to extract or otherwise prepare the materials using an aqueous solvent, as it is believed that the resulting materials will have a desirable hydrophilicity and/or log P values. It may be preferred that a distillation process is not used to prepare at least some of the materials, as it is believed that the resulting materials may not have the desired hydrophilicity and/or log P values. When a separation process is used to separate a material into hydrophobic/oil-based portions and hydrophilic/water-based portions, the hydrophilic/water-based portion may be used. Suitable fragrance materials may be prepared via an enzymatic treatment process, such as those described in Antoniotti, S., *Molecules* 2014, 19, 9203-9214 (available, for example, at https://www.mdpi.com/1420-3049/19/7/9203/htm).

Because the compositions of the present disclosure are typically characterized by a relatively low pH, the fragrance materials of the present disclosure are typically acid-stable, particularly at the pH of the composition. Acid stability may qualitatively be shown by the lack of phase separation, a lack of discoloration, and/or a lack of precipitate formation at an acidic pH upon storage, preferably at a pH of from about 2 to about 4.

Water and Other Optional Solvents

The fabric treatment compositions are typically aqueous compositions. Thus, the fabric treatment compositions comprise water. Typical hydrophobic fragrance materials in such aqueous compositions may be phase unstable in the absence of additional processing (such as emulsification), ingredients, or other interventions.

The fabric treatment compositions of the present disclosure may comprise from about 30%, or from about 40%, or from about 50%, to about 95%, or to about 90%, or to about 80%, or to about 75%, or to about 70%, by weight of the fabric composition, of water.

Although the fabric treatment compositions of the present disclosure are aqueous, the compositions may further comprise organic solvent, which can improve composition stability, ingredient dissolution, and/or transparency of the composition. The fabric treatment compositions may include from about 0.1% to about 30%, or from about 1% to about 20%, by weight of the composition, of organic solvent. Suitable organic solvents may include ethanol, diethylene glycol (DEG), 2-methyl-1,3-propanediol (MPD), monopropylene glycol (MPG), dipropylene glycol (DPG), oligamines (e.g., diethylenetriamine (DETA), tetraethylenepentamine (TEPA)), glycerine, propoxylated glycerine, ethoxylated glycerine, ethanol, 1,2-propanediol (also referred to as propylene glycol), 1,3-propanediol, 2,3-butanediol, cellulosic ethanol, renewable propylene glycol, renewable monopropylene glycol, renewable dipropylene glycol, renewable 1,3-propanediol, and mixtures thereof. One or more of the organic solvents may be bio-based, meaning that they are derived from a natural/sustainable, non-geologically-derived (e.g., non-petroleum-based) source.

Free of Certain Ingredients

The fabric treatment compositions of the present disclosure may comprise a limited number of ingredients, for example, no more than ten, or no more than nine, or no more than eight, or no more than seven, or no more than six, or no more than five ingredients. Limiting the number of ingredients can result in lower storage and/or transportation costs of raw materials, and/or simplify the process of making the compositions. Consumers may also desire products having a limited number of ingredients, as they may be perceived as simpler, as having a smaller environmental footprint, and/or as providing an easier-to-understand ingredient list.

As described above, the present compositions may be relatively transparent. Therefore, the present composition may be substantially free of particles, such as encapsulated benefit agents, silicone droplets, pearlescent agents, and/or opacifiers, which may reduce the relative transparency of the composition. The present compositions may be substantially free of dyes. As used herein the term "dye" includes aesthetic dyes that modify the aesthetics of the cleaning composition as well as dyes and/or pigments that can deposit onto a fabric and alter the tint of the fabric. Dyes include colorants, pigments, and hueing agents. The present compositions may be substantially free of optical brighteners.

The present compositions may be substantially free of detersive surfactant, bleaching systems, and/or fabric softening materials. Such materials may affect the aesthetics, physical stability, and/or chemical stability of the other ingredients in the present compositions. Additionally or alternatively, certain such materials may not be physically or chemically stable themselves in low-pH environment of the present compositions. Furthermore, consumers who use the present compositions may be hoping to remove materials from their treated fabrics, whereas at least some of the listed materials may instead deposit on fabric during a normal treatment cycle, building up undesirable residues.

The present compositions may be substantially free of detersive surfactants, including anionic, nonionic, amphoteric, and/or zwitterionic surfactants. Anionic surfactants may include: sulfated surfactants, such as alkyl sulfate or alkoxylated alkyl sulfate; sulfonated surfactants, such as (linear) alkyl benzene sulfonates; and/or carboxylated surfactants. Nonionic surfactants may include: alkoxylated fatty alcohols; alkoxylated alkyl phenols; and/or alkyl polyglucosides.

Zwitterionic surfactants may include amine oxide and/or betaines.

The present compositions may be substantially free of bleaching systems. Bleaching systems may include peroxide bleaches, such as hydrogen peroxide and/or sources of peroxide. Bleaching systems may include hypohalite bleaches, such as hypochlorite bleaches, or sources of such hypohalites. Bleaching systems may also include bleach activators, such as NOBS or TAED, or bleach catalysts.

The present compositions may be substantially free of fabric softening materials. Such materials may deposit on fabric, which may be less preferred for certain consumers, applications, or fabrics. Additionally or alternatively, such materials may require emusification or other processing to make them compatible with the present aqueous compositions. Fabric softening materials may be cationically charged and/or capable of becoming cationically charged in typical wash conditions. Fabric softening materials may include quaternary ammonium ester compounds, silicones, non-ester quaternary ammonium compounds, amines, fatty esters, sucrose esters, silicones, dispersible polyolefins, polysaccharides, fatty acids, softening or conditioning oils, polymer latexes, or combinations thereof. As used herein, the terms "fabric softening materials" is not intended to include any of the materials listed in the "Organic Acid(s)" section above, including vinegar or acetic acid.

In an effort to keep viscosity low, the compositions of the present disclosure may be substantially free of thickeners or other rheology enhancers, such as structurants. The compositions may be substantially free of salts, such as inorganic salts like sodium chloride, magnesium chloride, and/or calcium chloride, that can provide rheology modification such as thickening. As used herein, such salts are not intended to include the neutralization products of the organic acids described herein.

Although the present disclosure has discussed acetic acid and/or vinegar at length, the same principles can apply to treatment compositions that comprise citric acid when transparency is desired, even in the absence of acetic acid and/or vinegar. Citric acid is also a "natural" ingredient and may be a desirable ingredient of the relevant consumer. Thus, the present disclosure also relates to an aqueous liquid fabric treatment composition comprising an organic acid system, the organic acid system comprising citric acid; fragrance material, wherein the fragrance material is characterized by a log P of no greater than 2.5; wherein the fabric care composition is characterized by a neat pH of from about 1 to about 6. The above-described ingredients, levels, and properties can substantially apply to such compositions.

Packaging

The fabric treatment compositions described herein can be packaged in any suitable container, including those constructed from paper, cardboard, plastic materials, and any suitable laminates. The container may contain renewable and/or recyclable materials.

The fabric treatment composition may be contained in a transparent container, such as a transparent bottle. The transparent bottle or container may have a transmittance of more than about 25%, or more than about 30%, or more than about 40%, or more than about 50% in the visible part of the spectrum (approx. 410-800 nm). Alternatively, absorbency of the bottle may be measured as less than about 0.6 or by having transmittance greater than about 25%, where % transmittance equals:

$$\frac{1}{10^{absorbancy}} \times 100\%$$

For purposes of the disclosure, as long as one wavelength in the visible light range has greater than about 25% transmittance, it is considered to be transparent/translucent.

Clear bottle materials that may be used include, but are not limited to: polypropylene (PP), polyethylene (PE), polycarbonate (PC), polyamides (PA) and/or polyethylene terephthalate (PETE), polyvinylchloride (PVC); and polystyrene (PS). Recyclable materials may be preferred for environmental reasons.

The container or bottle may be of any form or size suitable for storing and packaging liquids for household use. For example, the container may have any size but usually the container will have a maximal capacity of about 0.05 to about 15 L, or about 0.1 to about 5 L, or from about 0.2 to about 2.5 L. The container may be suitable for easy handling. For example, the container may have handle or a part with such dimensions to allow easy lifting or carrying the container with one hand. The container may have a means suitable for pouring a liquid detergent composition and means for reclosing the container. The pouring means may be of any size or form. The closing means may be of any form or size (e.g., to be screwed or clicked on the container to close the container). The closing means may be cap, which can be detached from the container. Alternatively, the cap may be attached to the container, whether the container is open or closed.

The closing means may also be incorporated in the container.

Processes of Making

The present disclosure further relates to processes of making liquid fabric treatment compositions as described herein. Any suitable processes known in the art may be used, for example batch processes, in-line mixing, and/or circulation-loop-based processes.

The process of making a liquid fabric treatment composition may comprise the steps of: providing an aqueous base composition; combining acetic acid and/or vinegar with the aqueous base composition; and combining fragrance materials, which may be unemulsified fragrance materials, with the aqueous base; wherein the resulting liquid fabric care composition is characterized by a neat pH of from about 1 to about 6.

The aqueous base may include water. The aqueous base may include at least 50%, or at least 60%, or at least 70%, or at least 75%, or at least 80%, or at least 85%, or at least 90%, or at least 95%, by weight of the aqueous base, of water.

The fragrance materials are described in more detail above. For example, the fragrance materials may be characterized by a log P of no greater than 2.5. The fragrance materials may be unemulsified, which is believed to improve the transparency of the resulting composition.

The process may comprise adding vinegar to the aqueous base composition. The acetic acid and/or vinegar may be combined with the aqueous base before, simultaneously, or after the fragrance materials are combined with the aqueous base.

Processes of Using

The present disclosure also relates to processes of using the liquid fabric treatment compositions described herein. The processes may comprise contacting a fabric or other surface with a composition according to the present disclosure. The contacting step may occur in the presence of water. The composition may be dispersed or dissolved in the water, forming a treatment liquor.

The pH of the treatment liquor may be greater (e.g., closer to seven) than the pH of the fabric treatment composition. The treatment liquor may be characterized by a pH of from about 2, or from about 3, or from about 4 to about 7, or to about 6, or to about 5. The organic acid system of the fabric treatment composition may be selected so as to substantially buffer the treatment liquor to a desired pH. Additionally or alternatively, the fabric treatment composition may include other buffers or pH-balancing agents to deliver a desired pH in the treatment liquor.

The compositions are typically employed at concentrations of from about 500 ppm to about 15,000 ppm in solution (i.e., the treatment liquor).

The water temperature may range from about 5° C. to about 90° C. The weight ratio of the treatment liquor to fabric may be from about 1:1 to about 30:1.

The process may be a manual process, such as in a wash basin, or it may be an automatic process, occurring the drum of an automatic laundry machine. The machine may be a top-loading machine or a front-loading machine. The compositions of the present disclosure may be manually provided to the drum of an automatic washing machine, or they may be automatically provided, for example via a dispenser drawer or other vessel.

Typical treatment processes include at least one wash cycle and at least one subsequent rinse cycle. Fabrics may be treated with surfactant, such as anionic surfactant, during the wash cycle. The composition may be provided to the drum, and/or the fabrics may be contacted with the composition, during a rinse cycle.

COMBINATIONS

Specifically contemplated combinations of the disclosure are herein described in the following lettered paragraphs. These combinations are intended to be illustrative in nature and are not intended to be limiting.

A. A liquid fabric care composition comprising: from about 0.1% to about 20% vinegar, by weight of fabric care composition; from about 0.1% to about 20% fragrance materials, by weight of the fabric care composition, wherein the fragrance materials are characterized by a log P of less than about 2.5; and at least about 30% water, by weight of the fabric care composition; wherein the fabric care composition is characterized by a neat pH of from about 1 to about 6.

B. A composition according to paragraph A, wherein the composition comprises from about 0.1% to about 10%, or from about 0.5% to about 5%, or from about 1% to about 3% vinegar.

C. A composition according to any of paragraphs A or B, wherein the composition further comprises a second organic acid selected from citric acid, lactic acid, adipic acid, aspartic acid, carboxymethyloxymalonic acid, carboxymethyloxysuccinic acid, glutaric acid, hydroxyethlyliminodiacetic acid, iminodiactic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof, preferably citric acid.

D. An aqueous liquid fabric treatment composition comprising: an organic acid system, the organic acid system comprising acetic acid (and/or citric acid); fragrance material, wherein the fragrance material is characterized by a log P of no greater than 2.5; wherein the fabric care composition is characterized by a neat pH of from about 1 to about 6.

E. A composition according to paragraph D, wherein the acetic acid is present at a level of from about 0.05%, or from about 0.1%, or from about 0.15%, or from about 0.2% to about 5%, or to about 3%, or to about 2%, or to about 1%, or to about 0.5%, or to about 0.3%, by weight of the composition.

F. A composition according to paragraph E, wherein the organic acid system further comprises a second organic acid selected from acetic acid, citric acid, lactic acid, adipic acid, aspartic acid, carboxymethyloxymalonic acid, carboxymethyloxysuccinic acid, glutaric acid, hydroxyethlyliminodiacetic acid, iminodiactic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof, preferably citric acid and/or acetic acid.

G. A composition according to any of paragraphs A-F, wherein the composition comprises acetic acid and the second organic acid, preferably wherein the second organic acid is citric acid, in a weight ratio of from about 1:300, or from about 1:250, or from about 1:225, or from about 1:200, to about 1:1, or to about 1:10, or to about 1:50, or to about 1:100.

H. A composition according to any of paragraphs A-G, wherein the composition is characterized by a pH of from about 1.5 to about 5, preferably from about 2 to about 4, even more preferably from about 2 to about 3.

I. A composition according to any of paragraphs A-H, wherein the composition is characterized by Reserve Acidity to pH 4.0 of at least about 1, or at least about 3, or at least about 5.

J. A composition according to any of paragraphs A-I, wherein the composition comprises at least about 50% water, preferably at least about 60% water.

K. A composition according to any of paragraphs A-J, wherein at least about 50%, or at least about 60%, or at least about 70%, or at least about 80%, or at least about 90%, or at least about 95%, or about 100%, by weight of the fragrance materials, of the fragrance materials are naturally derived fragrance materials.

L. A composition according to any of paragraphs A-K, wherein the fragrance materials comprise a plant extract, preferably a plant extract selected from a fruit extract, an herbal extract, or mixtures thereof.

M. A composition according to any of paragraphs A-L, wherein the fragrance materials comprise a fruit extract, preferably a citrus extract, more preferably a lemon extract.

N. A composition according to any of paragraphs A-M, wherein the fragrance materials comprise an herbal extract, preferably lavender extract, rosemary extract, thyme extract, basil extract, or mixtures thereof, more preferably lavender extract.

O. A composition according to any of paragraphs A-N, wherein the fragrance materials comprise a plurality of materials, wherein at least about 60%, by weight of the plurality of materials, are characterized by log P of no greater than about 2.5.

P. A composition according to any of paragraphs A-O, wherein the composition is characterized by a viscosity of from about from about 1 to about 200 cps, as determined by rotational viscometry using a Brookfield viscometer and the ASTM D 2196-99 at 60 RPM and 22° C.

Q. A composition according to any of paragraphs A-P, wherein the composition is characterized by a percent transmittance (% T) of at least about 60%, or at least about 70%, or at least about 80%, or at least about 90%, or at least about 95% of light using a 1 centimeter cuvette, at a wavelength of about 410-800 nanometers, preferably about 570-690 nanometers, when the composition is substantially free of dyes.

R. A composition according to any of paragraphs A-Q, wherein the composition is substantially free of detersive surfactant, bleaching systems, and/or fabric softening materials.

S. A process of making a liquid fabric care composition, the process comprising the steps of: providing an aqueous base; combining vinegar with the aqueous base; combining fragrance materials with the aqueous base, wherein the fragrance materials, as added to the aqueous base, are characterized by a log P of no greater than 2.5; wherein the resulting liquid fabric care composition is characterized by a neat pH of from about 1 to about 6.

T. A process according to paragraph S, wherein the fragrance materials are unemulsified when combined with the aqueous base.

TEST METHODS

Unless otherwise indicated, the following Test Methods are used for the following determinations.

Determination of pH

Unless otherwise stated herein, the pH of the composition is defined as the neat pH of the composition at 20±2° C. Any meter capable of measuring pH to ±0.01 pH units is suitable. Orion meters (Thermo Scientific, Clintinpark -Keppekouter, Ninovesteenweg 198, 9320 Erembodegem -Aalst, Belgium) or equivalent are acceptable instruments. The pH meter should be equipped with a suitable glass electrode with calomel or silver/silver chloride reference. An example includes Mettler DB 115. The electrode should be stored in the manufacturer's recommended electrolyte solution. The pH is measured according to the standard procedure of the pH meter manufacturer. Furthermore, the manufacturer's instructions to set up and calibrate the pH assembly should be followed.

Determination of Viscosity

The viscosity of a composition is determined by rotational viscometry using a Brookfield viscometer and the ASTM D 2196-99 at 60 RPM and 22° C.

Stain Removal

Stain Removal testing is conducted in Front Loader HE machines, in line with the guidance provided by ASTM4265-14 Standard Guide for Evaluating Stain Removal Performance in Home Laundering. Technical stain swatches of cotton CW120 containing 22 stains were purchased. The stained swatches were washed in conventional North American washing machines (Whirlpool®) using 7 grains per gallon hardness, selecting the normal cycle at 86F, using each of the respective detergent compositions listed in the table below. Image analysis was used to compare each stain to an unstained fabric control. Software converted images taken into standard colorimetric values and compared these to standards based on the commonly used Macbeth Colour Rendition Chart, assigning each stain a colorimetric value (Stain Level). Eight replicates of each were prepared. The stain removal index was then calculated according to the formula shown below.

Stain removal from the swatches was measured as follows:

$$\text{Stain Removal Index } (SRI) = \frac{\Delta E_{initial} - \Delta E_{washed}}{\Delta E_{initial}} \times 100$$

$\Delta E_{initial}$ = Stain level before washing $\Delta E_{washed}$ = Stain level after washing Stability Method Once samples are prepared, store in glass containers with a lid at ambient conditions including 22 C for a minimum of 12 hours. This allows the perfume to solubilize in the product. After 12 hours, complete a visual inspection. If a phase separation is visible, for example, if there is an oil separation at the top, the sample is deemed to be not stable.

Transmittance (% T)

As a measurement of the relative transparency/translucency of a composition, the percent transmittance (% T) of the composition may be determined.

Prior to measuring percent transmittance, vigorously shake a jar containing the composition for 10 seconds. Immediately place a sample into a 1-cm cuvette. Vigorously shake the sample in the cuvette for 10 seconds. Wait 30 seconds and measure the percent transmittance.

The percent transmittance of a composition is measured at the desired wavelength a standard 10 mm pathlength cuvette with a Beckman DU spectrophotometer, in the absence of dyes.

Log P

The log P of a material or mixture of materials is determined according to the following method(s), and according to the following hierarchy:

For single materials and/or simple mixtures:

Use the Consensus log P when possible (for example, when a known, simple material).

If Consensus log P is not available, then use Classic log P if possible.

If Classic log P is not available, then use Measured log P if possible.

For other mixtures (for example, more complex mixtures or essential oils/extracts):

Use the Composite log P when possible.

If Consensus log P is not available, then use the Mixture Measurement log P as described below.

As used herein, "log P" refers to the value provided when the hierarchy above and the methods below are followed.

The degree of hydrophobicity of a perfume ingredient can be correlated with its octanol/water partitioning coefficient P. The octanol/water partitioning coefficient of a perfume ingredient is the ratio between its equilibrium concentration in octanol and in water. A perfume ingredient with a greater partitioning coefficient P is more hydrophobic. Conversely, a perfume ingredient with a smaller partitioning coefficient P is more hydrophilic. Since the partitioning coefficients of the perfume ingredients normally have high values, they are more conveniently given in the form of their logarithm to the base 10, log P.

This model computes the octanol-water partition coefficient (log P or log Kow) for general organic molecules based directly on molecular structure. Log P is a measure of the distribution of a solute between two immiscible liquid phases, octanol and water, and is generally used as a relative measure of the hydrophobicity of a solute. It is computed in this instance using the ACD/Labs Log P module. This release is based on Version 14.02 (Linux) of the ACD/Labs module acdlabs.com.

Three algorithms are employed for computing log P: 1) Classic algorithm, 2) GALAS algorithm, and 3) the Consensus algorithm. The Classic method is essentially what it sounds like, a classic style of log P calculation based on molecular fragments. It works well and is broadly applicable. The GALAS algorithm is a new method that essentially starts with the Classic value, and then adjusts the value based on experimental data it has for that molecule or for very similar molecules in its large supporting database. So, the GALAS method can be very accurate if the molecule or very similar molecules are in the underlying database. The Consensus method is a weighted combination of the Classic and GALAS values. It takes into account the degree of reliability of the GALAS result, which reflects the similarity of the query structure to the molecules it found in the database. If the GALAS method is more reliable, then the Consensus method will give it more weight, otherwise the Consensus value will be closer to the Classic value. It is recommended that the Consensus values be used for general purposes because while the Classic algorithm produces good values, the GALAS algorithm can yield more accurate values if there are sufficient examples of similar structures in the underlying module database to provide adjustments. However, the since the query can be unique, the GALAS values may not be as accurate. The Consensus method combines the Classic and GALAS values using an adaptive weighting scheme that takes into account the reliability index associated with the GALAS value. Thus, the Consensus method should provide the best overall single value for log P. All three values are reported in the output that this model provides so that users can be made aware of the differences between the three, and make an informed choice on which value to use. The ACD/lab Log P predictions included in the table below are the Consensus algorithm. The Clog P values, which are the most reliable and widely used estimates for this physicochemical property, are used instead of the experimental log P values in the selection of perfume ingredients which are useful in the present invention.

Measured Log p:

The identity and quantity of each perfume raw material (PRM) in a test composition is determined via liquid analysis of straight perfume oil or dilutions of the perfume oil using the analytical chromatography technique of Gas Chromatography Mass Spectrometry with Flame Ionization Detection (GC-MS/FID), conducted using a non-polar or slightly-polar column.

Suitable instruments for conducting these GC-MS/FID analyses includes equipment such as: Hewlett Packard/Agilent Gas Chromatograph model 7890 series GC/FID (Hewlett Packard/Agilent Technologies Inc., Santa Clara, Calif., U.S.A.); Hewlett Packard/Agilent Model 5977N Mass Selective Detector (MSD) transmission quadrupole mass spectrometer (Hewlett Packard/Agilent Technologies Inc., Santa Clara, Calif., U.S.A.); Multipurpose AutoSampler MPS2 (GERSTEL Inc., Linthicum, Md., U.S.A); and 5%-Phenyl-methylpolysiloxane Column J&W DB-5 (30 m length×0.25 mm internal diameter×0.25 μm film thickness) (J&W Scientific/Agilent Technologies Inc., Santa Clara, Calif., U.S.A.).

One skilled in the art will understand that in order to identify and quantify the PRMs in a composition, the analytical steps may involve: the use of external reference standards; and generation of area response values; and the comparison of measured results against retention times and mass spectra peaks obtained from reference databases and libraries.

The log P of the perfume oil composite is performed is a multi-step process of identification, determination of relative abundance, and Log P database prediction. The weight percent of each PRM is calculated by the FID area response of that PRM divided by the total FID area response of all PRMs. The log P of each individual material is determined by the using the Consensus value of the ACD/log p predictive method. The reported composite Log P is calculated by multiplying the individual PRM weight fraction by its respective log P for all PRMs then summing the total.

In the perfume art, some auxiliary materials having no odor, or a low odor, are used, e.g., as solvents, diluents, extenders or fixatives. Non-limiting examples of these materials are ethyl alcohol, ethanol, carbitol, dipropylene glycol, diethyl phthalate, triethyl citrate, isopropyl myristate, and benzyl benzoate. These materials are used for, e.g., solubilizing or diluting some solid or viscous perfume ingredients to, e.g., improve handling and/or formulating. These materials are useful in the perfume composition, and they are counted in the calculation of the definition/formulation of the perfume compositions for the composite log P of the present invention. A sample calculation is provided below.

| Fragrance material | wt % | LogP Consensus | weighted LogP |
|---|---|---|---|
| alpha Thuyene | 0.195 | 4.064 | 0.008 |
| alpha Pinene | 1.060 | 4.138 | 0.044 |
| beta Pinene | 1.179 | 3.925 | 0.046 |
| 1,8 Cineole | 1.320 | 2.854 | 0.038 |
| d-Limonene | 1.850 | 4.403 | 0.081 |
| Camphor | 0.855 | 2.490 | 0.021 |
| Linalool | 83.903 | 3.285 | 2.756 |
| Terpinen-4-ol | 0.563 | 3.073 | 0.017 |
| Terpineol | 4.987 | 3.036 | 0.151 |
| Linalool trans-oxide | 1.060 | 2.089 | 0.022 |
| Geraniol | 2.510 | 3.409 | 0.086 |
| Nerol | 0.519 | 3.409 | 0.018 |
| | | | Composite logP = 3.29 |

When hydrophilic perfume is desired, at least about 25% by weight of the perfume, more preferably about 50%, most preferably about 75%, is composed of perfume ingredients having a Clog P of about 2.5 or smaller.

EXAMPLES

The examples provided below are intended to be illustrative in nature and are not intended to be limiting.

Example 1. Illustrative Compositions

Table 1 shows compositions according to present disclosure.

TABLE 1

| | 1A | 1B | 1C | 1D |
|---|---|---|---|---|
| MATERIAL | | | | |
| Citric Acid | 23.7% | 12.5% | 23.7% | 23.7% |
| Vinegar (6% acetic Acid) | 2.6% | 1.3% | 5.0% | 5.0% |
| Sodium Hydroxide | 2.0% | 1.0% | 2.3% | 3.0% |
| 1,2 propanediol | 5.0% | 2.5% | 5.0% | 5.0% |
| Perfume | 0%-1.0% | 0%-1.0% | 0%-1.0% | 0%-1.0% |
| Deionized Water | Balance | Balance | Balance | Balance |
| PROPERTIES | | | | |
| Neat pH | 2.5 | 2.5 | 2.5 | 3.5 |
| Reserve Acidity to pH = 4 | 3.0 | 3.0 | 3.0 | 3.0 |
| Viscosity (cp) (60 RPM, 22° C.) | Less than 10 cp | Less than 10 cp | Less than 10 cp | Less than 10 cp |

Example 2. Stability Testing (1)—Individual Perfume Materials

Four composition samples according to Table 1, Example 1 are prepared. Each sample has a different perfume material, as indicated in Table 2. Each of the four perfume materials has a different ACD labs consensus model prediction of Log P. The perfumes are tested at two different weight percent levels—0.5% and 1%. The stability and % T of each sample is assessed according to the Test Methods provides above. Results are provided in Table 2. Examples 2A and 2B are comparative examples, and Examples 2C and 2D are examples according to the present disclosure.

TABLE 2

| | 2A | | 2B | | 2C | | 2D | |
|---|---|---|---|---|---|---|---|---|
| Perfume | d-Limonene (comp.) | | Beta-Ionone (comp.) | | Pyranol (inv.) | | Phenyl Ethyl Alcohol (inv.) | |
| LogP (Consensus) | 4.40 | | 3.82 | | 2.31 | | 1.50 | |
| CAS# | 5989-27-5 | | 79-77-6 | | 63500-71-0 | | 60-112-8 | |
| Level (wt %) | 0.5% | 1% | 0.5% | 1% | 0.5% | 1% | 0.5% | 1% |
| Stable (yes/no) | NO | NO | NO | NO | YES | YES | YES | YES |
| % T at 570 nm | 53.2 | 38.1 | 42.7 | 17.1 | 96 | 90.7 | 99.2 | 98.2 |

Example 3. Stability Testing (2)—Mixtures of Perfume Materials

Two composition samples according to Table 1, Example 1 are prepared. Each sample has a different mixture of commercially available perfume materials, as indicated in Table 3. Both perfumes are believed to be derived from lemons, for example lemon oil and/or lemon extract. The perfumes are obtained from TREATT (Bury St. Edmunds, UK).

Each of the two perfume mixtures is characterized by a Composite Log P. The perfumes are tested at two different weight percent levels—0.5% and 1%. The stability and % T of each sample is assessed according to the Test Methods provides above. Results are provided in Table 3. Example 3A is an example according to the present disclosure, and Example 3B is a comparative example.

TABLE 3

| | 3A | | 3B | |
|---|---|---|---|---|
| Perfume | TreattClear Lemon Primo™ (inv.) | | Lemon Cedrat CFR™ (comp.) | |
| Composite logP | −0.1 | | 4.29 | |
| Level (wt %) | 0.5% | 1% | 0.5% | 1% |
| Stable (yes/no) | YES | YES | NO | NO |
| % T at 570 nm | 98.6 | 79 | 36.8 | 33.2 |

Example 4. Stain Removal Performance

A stain removal test is run to determine the stain removal performance of the rinse added product alone and in combination with a detergent product.

The rinse product tested is a composition according to Table 1, Example 1, provided above, with 1% of perfume, according to the present disclosure.

The detergent product tested is a low-pH liquid heavy duty detergent (HDL) product according to the formulation provided in Table 4-1. The detergent product is characterized by a pH of about 2.5.

TABLE 4-1

| | Wt % (active) |
|---|---|
| Anionic surfactant (C11.8 HLAS) | 6.8 |
| Nonionic surfactant (C12-14 EO9) | 10.8 |
| Citric acid | 14.0 |
| Organic solvent | 3.0 |
| Caustic | 1.0 |
| Acetic acid (added as vinegar) | 0.1 |
| Perfume | 1.0 |
| Water | Balance |

Stain removal data is obtained for the detergent product only (Example 4A), for a regimen of the detergent product followed by the rinse-added product (4B), and for the rinse product only (4C). The testing is conducted according to the Stain Removal method provided above. The detergent product is added into the detergent drawer at about 50 mL, and the rinse composition is added into the rinse drawer at about 50 mL. A variety of soils/stains are tested, but only those showing significance over the performance of the detergent alone are provided in Table 4-2.

TABLE 4-2

| Soil | 4A (Detergent only) | 4B (Detergent + Rinse) | Delta (4B - 4A) | 4C (Rinse only) | Delta (4C - 4A) |
|---|---|---|---|---|---|
| Grass | 45.7 | 66.2 | 20.5* | 57.6 | 11.9 |
| Lipton™ Tea | 42.8 | 55.1 | 12.3* | 48.3 | 5.6 |
| Nescafe™ Coffee | 44.5 | 55.1 | 10.6* | 50.9 | 6.4 |

* = significant at a 95% confidence interval

As shown in Table 4-2, the combination of detergent followed by a rinse composition according to the present disclosure provides significant cleaning improvements at a 95% confidence interval on Grass, Lipton™ tea, and Nescafe™ coffee.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric care composition comprising:

from about 0.1% to about 20% vinegar, by weight of fabric care composition, from about 10% to about 40% of a second organic acid, by weight of the fabric care composition, wherein the second organic acid is selected from the group consisting of citric acid, lactic acid, adipic acid, aspartic acid, carboxymethyloxymalonic acid, carboxymethyloxysuccinic acid, glutaric acid, hydroxyethlyliminodiacetic acid, iminodiactic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof, from about 0.1% to about 20% fragrance materials, by weight of the fabric care composition, wherein the fragrance materials are characterized by a logP of less than about 2.5; and at least about 30% water, by weight of the fabric care composition;

wherein the fabric care composition is characterized by a neat pH of from about 1 to about 6; and wherein the fabric care composition is substantially free of detersive surfactant, bleaching systems, and fabric softening materials, wherein the detersive surfactant is selected from the group consisting of anionic surfactants, nonionic surfactants, amphoteric surfactants, zwitterionic surfactants, and combinations thereof, wherein the bleaching systems are selected from the group consisting of peroxide bleaches, hypohalite bleaches, bleach activators, bleach catalysts, and combinations thereof, and wherein the fabric softening materials are selected from the group consisting of quaternary ammonium ester compounds, silicones, non-ester quaternary ammonium compounds, amines, fatty esters, sucrose esters, silicones, dispersible polyolefins, polysaccharides, fatty acids, softening or conditioning oils, polymer latexes, and combinations thereof.

2. A composition according to claim 1, wherein the composition comprises from about 0.1% to about 10% vinegar, by weight of the composition.

3. A composition according to claim 1, wherein the second organic acid is citric acid.

4. A composition according to claim 1, wherein the fragrance materials comprise a plurality of materials, wherein at least about 60%, by weight of the plurality of materials, are characterized by logP of no greater than about 2.5.

5. A composition according to claim 1, wherein the composition is characterized by a viscosity of from about from about 1 to about 200 cps, as determined by rotational viscometry using a Brookfield viscometer and ASTM D 2196-99 at 60 RPM and 22° C.

6. A composition according to claim 1, wherein the composition is characterized by a percent transmittance (% T) of at least about 60% of light using a 1 centimeter cuvette, at a wavelength of about 410-800 nanometers when the composition is substantially free of dyes.

7. An aqueous liquid fabric treatment composition comprising an organic acid system, the organic acid system comprising acetic acid and a second organic acid, wherein the second organic acid is present at a level of from about 10% to about 40%, by weight of the fabric care composition, wherein the second organic acid is selected from the group consisting of citric acid, lactic acid, adipic acid, aspartic acid, carboxymethyloxymalonic acid, carboxymethyloxysuccinic acid, glutaric acid, hydroxyethlyliminodiacetic acid, iminodiactic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof;

fragrance material, wherein the fragrance material is characterized by a logP of no greater than 2.5;

wherein the fabric care composition is characterized by a neat pH of from about 1 to about 6; and wherein the composition is substantially free of detersive surfactant, bleaching systems, and fabric softening materials.

8. A composition according to claim 7, wherein the acetic acid is present at a level of from about 0.05% to about 5%, by weight of the composition.

9. A composition according to claim 7, wherein the second organic acid is citric acid.

10. A composition according to claim 7, wherein the composition comprises acetic acid and the second organic acid in a weight ratio of from about 1:300 to about 1:1.

11. A composition according to claim 7, wherein the composition is characterized by a pH of from about 1.5 to about 5.

12. A composition according to claim 7, wherein the composition is characterized by Reserve Acidity to pH 4.0 of at least about 1.

13. A composition according to claim 7, wherein the composition comprises at least about 50% water.

14. A composition according to claim 7, wherein at least about 50%, by weight of the fragrance materials, of the fragrance materials are naturally derived fragrance materials.

15. A composition according to claim 7, wherein the fragrance materials comprise a fruit extract, the fruit extract comprising lemon extract.

16. A composition according to claim 7, wherein the fragrance materials comprise an herbal extract selected from the group consisting of lavender extract, rosemary extract, thyme extract, basil extract, and mixtures thereof.

17. A process of making a liquid fabric care composition, the process comprising the steps of:

providing an aqueous base;

combining vinegar with the aqueous base;

combining fragrance materials with the aqueous base, wherein the fragrance materials, as added to the aqueous base, are characterized by a logP of no greater than 2.5;

wherein the resulting liquid fabric care composition is characterized by a neat pH of from about 1 to about 6, wherein the resulting liquid fabric care composition further comprises from about 10% to about 40% of a second organic acid, by weight of the fabric care composition, wherein the second organic acid is selected from the group consisting of citric acid, lactic acid, adipic acid, aspartic acid, carboxymethyloxymalonic acid, carboxymethyloxysuccinic acid, glutaric acid, hydroxyethlyliminodiacetic acid, iminodiactic acid, maleic acid, malic acid, malonic acid, oxydiacetic acid, oxydisuccinic acid, succinic acid, sulfamic acid, tartaric acid, tartaric-discuccinic acid, tartaric-monosuccinic acid, or mixtures thereof, wherein the resulting liquid fabric care composition is substantially free of detersive surfactant, bleaching systems, and fabric softening materials, and wherein the composition is characterized by a percent transmittance (% T) of at least about 60% of light using a 1 centimeter cuvette, at a wavelength of about 410-800 nanometers when the composition is substantially free of dyes.

18. A process according to claim 17, wherein the fragrance materials are unemulsified when combined with the aqueous base.

* * * * *